United States Patent [19]

Becker et al.

[11] Patent Number: 4,563,251

[45] Date of Patent: Jan. 7, 1986

[54] LAYERED MULTICHANNEL METAL PLATES FOR IMAGE AMPLIFIERS

[75] Inventors: Erwin Becker; Wolfgang Ehrfeld, both of Karlsruhe; Frank Becker, Munich, all of Fed. Rep. of Germany

[73] Assignee: Kernforschungszentrum Karlsruhe GmbH, Karlsruhe, Fed. Rep. of Germany

[21] Appl. No.: 708,842

[22] Filed: Mar. 6, 1985

[30] Foreign Application Priority Data

Mar. 10, 1984 [DE] Fed. Rep. of Germany ..... 3408849

[51] Int. Cl.[4] ..... C25D 1/02; C25D 1/10

[52] U.S. Cl. ..... 204/6; 204/9; 204/11

[58] Field of Search ..... 204/6, 9, 11, 35.1, 204/37.1

[56] References Cited

U.S. PATENT DOCUMENTS 4,422,905 12/1983 Becker et al. ..... 204/9
4,493,753 1/1985 Becker ..... 204/9

FOREIGN PATENT DOCUMENTS 3039110 5/1982 Fed. Rep. of Germany ..... 204/11
2414658 1/1983 Fed. Rep. of Germany ..... 204/11
3150257 6/1983 Fed. Rep. of Germany ..... 204/11

OTHER PUBLICATIONS

Michael Lampton, "Spektrum der Wissenschaft" [Science Spectrum] Jan. 1982, pp. 44–55.
S. Birkle et al., "Metall" [Metal] 36 edition, vol. 4, Apr. 1982, 3 pages.
Cr. Heinz W. Dettner et al., "Handbuch der Galvanitechnik" [Handbook of Electroplating] vol. 1, part 2, pp. 1041–1043, published by Carl Hauser Verlag, Munich 1964.

*Primary Examiner*—T. M. Tufariello
*Attorney, Agent, or Firm*—Spencer & Frank

[57] ABSTRACT

A method for producing a multichannel plate containing metal dynodes and having a plurality of generally parallel channels for use in structures for amplifying or converting optical images or other two-dimensional signal patterns by secondary electron multiplication, which method includes:

producing a negative mold of the plate by:

(i) providing a body having at least the thickness of the plate to be produced and made of an electrically insulating material whose ability to be removed from the body is altered by exposure to a selected radiation;

(ii) irradiating the body with the selected radiation in a pattern corresponding to the plate to be produced and in a manner to render portions of the body having the form of a grid surrounding the channels more easily removable than the remaining portions of the body; and (iii) removing the more easily removable portions of the body to leave columnar structures corresponding to the channels in the plate;

depositing metal layers and intermediate layers alternatingly in the openings in the negative mold or in a secondary negative mold produced therefrom, the metal layers being deposited electrolytically and forming dynodes which are spaced apart in the direction of the channels; and removing the negative mold from the deposited layers.

15 Claims, 9 Drawing Figures

LAYERED MULTICHANNEL METAL PLATES FOR IMAGE AMPLIFIERS

BACKGROUND OF THE INVENTION

The present invention relates to a method for producing layered multichannel metal plates containing dynodes for amplifying optical images or other two-dimensional signal patterns by means of secondary electron multiplication and to the use of multichannel plates produced according to this method.

It is known to amplify optical images or other two-dimensional signal patterns, or arrays, by means of so-called multichannel plates as described in Federal Republic of Germany Laid-Open Application DE-OS No. 3,150,257 and Federal Republic of Germany Patent DE-PS No. 2,414,658. Such plates are composed of a plurality of electrically mutually insulated metal layers provided with closely adjacent holes, with a plurality of these plates being stacked in such a manner that the holes form closely adjacent channels extending essentially perpendicularly to the major surfaces of the plate.

The layers are individually connected to a voltage source in such a manner that a step-wise potential gradient is created between them. Thus the channels perform the function of secondary electron multipliers, with the metal layers provided with the holes constituting the dynodes. The holes of the individual dynodes may be produced by chemically etching through illuminated and developed photo resist masks.

Good results are obtained in practice if the hole diameters and the thickness of the dynode are approximately the same. "Spektrum der Wissenschaft" [Science Spectrum], January 1982, pages 44–55, further indicates that in multichannel image amplifier plates made of glass the channels should be given a curvature or arranged to follow a zigzag pattern. In the latter case, a plurality of plates having channels which are oblique to the plate surfaces are stacked.

If, in stacked multichannel image amplifier plates, spatial resolution is to be as high as in image amplifier plates made of glass, the diameters of the holes and thus the thicknesses of the dynodes must be of the order of magnitude of 30 microns or less. This results in considerable problems in mutual alignment and electrical insulation of the separately produced foil-like dynodes.

SUMMARY OF THE INVENTION

It is an object of the present invention to produce layered multichannel image amplifier plates of the above type, wherein the separate production of the dynodes and subsequent stacking and mutual alignment is avoided.

The above and other objects are achieved, in a method for producing a multichannel plate containing metal dynodes and having a plurality of generally parallel channels for use in structures for amplifying or converting optical images or other two-dimensional signal patterns by secondary electron multiplication, by the steps of:

(a) producing a negative mold of the plate, which negative mold has structures corresponding to the channels and is mounted on a metal electrode, the negative mold being produced pursuant to a fabrication procedure including the steps of:
  (i) providing a body having at least the thickness of the plate to be produced and made of an electrically insulating material whose ability to be removed from the body is altered by exposure to a selected radiation;
  (ii) irradiating the body with the selected radiation in a pattern corresponding to the plate to be produced and in a manner to render portions of the body having the form of a grid surrounding the channels more easily removable than the remaining portions of the body; and
  (iii) removing the more easily removable portions of the body to leave columnar structures corresponding to the channels in the plate;

(b) depositing metal layers and intermediate layers alternatingly in the openings in the negative mold, the metal layers being deposited electrolytically and forming dynodes which are spaced apart in the direction of the channels; and (c) removing the negative mold from the deposited layers.

With the method according to the present invention it is possible to produce layered multichannel plates containing metal dynodes wherein a similarly high spatial resolution and a similarly high transparency can be realized as in the known image amplifier plates made of glass while gain and signal repetition rate are improved compared with image amplifier plates made of glass.

To reduce the costs of mass producing such multichannel plates, the method acording to the present invention may be implemented by producing, from a primary negative mold of the layered multichannel plate and by means of a metal electrode connected thereto, a metallic positive mold by electrolytic molding and subsequent removal of the primary negative mold whereupon, by repeated filling of the metallic positive mold with a molding mass, a plurality of secondary negative molds of the layered multichannel plate are produced, with the secondary negative molds taking over the role of the primary negative mold during the further practice of the method. Nonadhesive reaction resins are particularly suitable as the molding mass. Further details with respect to the molding process may be found, for example, in German Patent No. 3,206,820, corresponding to U.S. application Ser. No. 470,281, Becker et al, now U.S. Pat. No. 4,541,977.

According to a particular embodiment, the dynodes are mutually electrically insulated by removal of the intermediate layers. If layered multichannel plates having larger diameters are to be produced in this manner, it may be of advantage to apply electrically insulating supports not only at the channel-free edge but also within the viewing field penetrated by the channels of the multichannel plate.

Although the supports in the region penetrated by the channels in the layered multichannel plates produced according to the above-described embodiment claim 3 in practice cover only about 0.1 percent of the viewing field, they may be considered a drawback if particularly high demands are placed on transmission quality. For this case, the method can be modified by using, for the intermediate layers, a material which is more easily oxidizable than the dynode layers and which is converted to an electrical insulator after removal of the negative mold. Aluminum is particularly suitable for the subsequent conversion of the intermediate layer to an electrical insulator. With the thin walls typical for high transparency multichannel plates, aluminum can be converted in a known manner to the electrically excellent insulating material $Al_2O_3$ by means of oxidation agents which operate in the liquid and/or gaseous phase. If, in the layered multichannel plates produced in this manner, the region penetrated by the channels is to be surrounded by a region without channels so as to facilitate installation or the making of electrical connections, this channel-free region, in order to safeguard the conversion of the more easily oxidizable material to an insulator, must be made of a plurality of thin walls.

The restriction to thin walls is eliminated if the intermediate layers are produced by complete or partial oxidation of electrolytically deposited aluminum layers. Oxidation of the aluminum layers is possible chemically as well as electrochemically. To facilitate the electrolytic deposition of the aluminum layers on the oxide layers underneath, it may be advisable to precipitate thin metal layers on the oxide layers which, during the subsequent electrolytic process, permit the supply of current parallel to the plate surface.

In cases where aluminum is acceptable as the dynode material, the operation just described can be simplified by using aluminum as the material for the dynode layers and by producing the intermediate layers by partial oxidation of the dynode layers.

If the channels are oriented to extend obliquely with respect to the plate surfaces, collison of primary particles with the channel walls, and thus the desired electron release are enhanced. In the prior art methods for producing layered multichannel plates, the oblique position of the channels is realized by mutual displacement of the dynodes during stacking. However, this produces offsets between associated channels of adjacent dynodes resulting in reduction of transparency and/or spatial resolution. In the layered multichannel plates produced according to the method of the present invention, the oblique orientation of the channels can be realized without losses of transparency and/or spatial resolution by correspondingly orienting the plate surface with respect to the propagation direction of the high energy radiation used for forming the primary negative mold.

Curving the channels for the purpose of suppressing the acceleration of parasitic ions can be realized in the prior art methods for stacked multichannel plates likewise only by mutually shifting the dynodes, resulting in the above-mentioned drawbacks. In the method according to the present invention, these drawbacks can be avoided in that the negative molds for the channels are curved at an increased temperature by a uniformly attacking force, for example a centrifugal force, before the dynodes and intermediate layers are produced.

However, suppression of acceleration of parasitic ions is also possible in that at least two multichannel plates produced according to the present invention and having channels oriented obliquely with respect to the plate surface are combined in a known manner to form a stack in such a way that the channels together form zigzag structures. Since, in the layered multichannel plates produced according to the present invention, the cross sections and positions of the channels can be precisely given, the layered multichannel plates having oblique channels can be stacked so that the channel openings of superposed layered multichannel plates are aligned with one another. This avoids losses in transparency and/or spatial resolution.

Corpuscular radiation as well as electromagnetic waves can be used as the high energy radiation for forming the primary negative mold. While, with the use of electromagnetic waves, masks are used in a known manner to produce the desired structures, the structures can also be produced by electromagnetic control if corpuscular radiation is employed. X-ray radiation generated by electron synchrotrons, i.e. synchrotron radiation, which is distinguished by high intensity at a small aperture, has been found to be particularly satisfactory. The selection of the material that is to be changed by the high energy radiation depends on the type of high energy radiation employed, with the appropriate rules for their use being described, for example in DE-PS No. 2,922,642 and counterpart U.S. Pat. No. 4,422,905 and DE-OS No. 3,221,981 and counterpart U.S. application Ser. No. 502,721, Becker et al, now U.S. Pat. No. 4,493,753. If synchrotron radiation is employed, polymethylmethacrylate (PMMA) has been found to be particularly suitable and a developer as disclosed in DE-OS No. 3,039,110 can be used to remove the irradiated regions.

By way of suitable surface treatments, for example weak oxidation with oxygen or chlorine at increased temperatures, electrochemical treatment by precipitation of a thin layer of material according to the chemical vapor deposition (CVD) method or a combination of such methods, it is possible to considerably increase, in a known manner, under certain circumstances, the secondary electron yield factor for the metal layers provided with the channels.

The method according to the present invention will now be described for an exemplary embodiment which is illustrated in the drawings.

DESCRIPTION OF THE PREFERRED EMBODIMENTS

Figure 1:
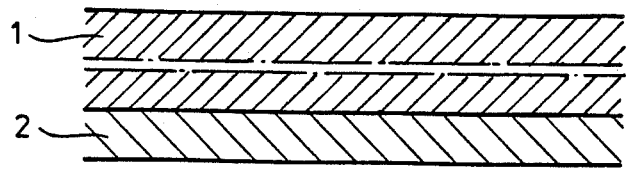
FIGS. 1, 2 and 3 are schematic cross-sectional views of the individual steps in the production of a negative mold for the production of a layered multichannel plate.

According to FIG. 1, the starting material for the production of the negative mold for a layered multichannel plate is a plate 1, 0.5 mm thick, of polymethylmethacrylate (PMMA) which is permanently connected with a metal electrode 2.

Figure 2:
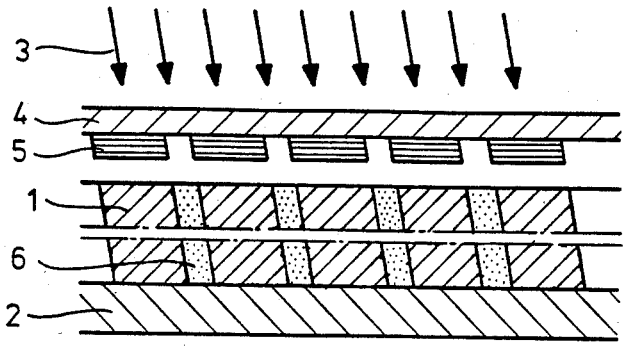

As shown in FIG. 2, PMMA plate 1 is irradiated through an X-ray mask 4,5 with synchrotron radiation 3 directed obliquely to the surfaces of PMMA plate 1 and of the X-ray mask. The X-ray mask is composed of a carrier 4 which only weakly absorbs the X-ray radiation and an absorber 5 which is highly absorbent for X-ray radiation and through which the cross-sectional shapes and positions of the negative molds of the channels are determined. The individual structures of absorber 5 correspond to the cross-sectional configurations of the negative molds of the channels.

Figure 3:
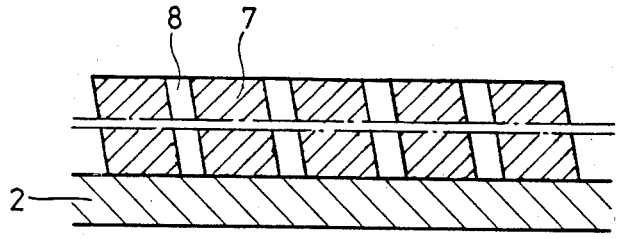

The high intensity collimated synchrotron radiation causes radiation chemical changes in the PMMA in its regions 6 not obturated by the absorber 5. The thus irradiated regions 6 are removed by introducing the PMMA plate into a developer solution so that a multichannel negative mold having columnar PMMA structures 7 and grid-like spaces 8, as shown in FIG. 3, results. The columnar PMMA structures 7 each have a hexagonal cross section and a width of about 30 microns, and the width of the free spaces 8 between the PMMA structures 7 is about 4 microns.

Figure 4:
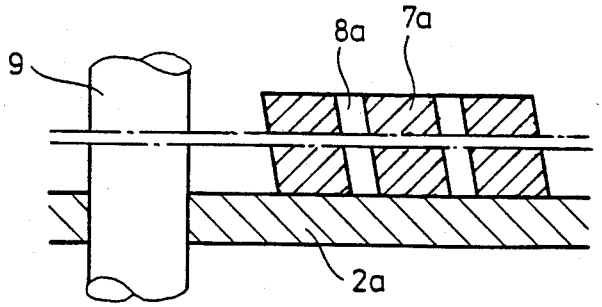
FIGS. 4 and 5 are schematic cross-sectional views of the production of dynode layers which are firmly connected with electrically insulating supports.

The production of a multichannel plate with individual dynodes which are permanently connected with electrically insulating supports is based on a negative mold as shown in FIG. 4 which, in addition to a metal electrode 2*a* and columnar PMMA structures 7*a* with grid-shaped spaces 8*a*, all as shown already in FIG. 3, additionally includes supports 9 of an electrically insulating material.

Figure 5:
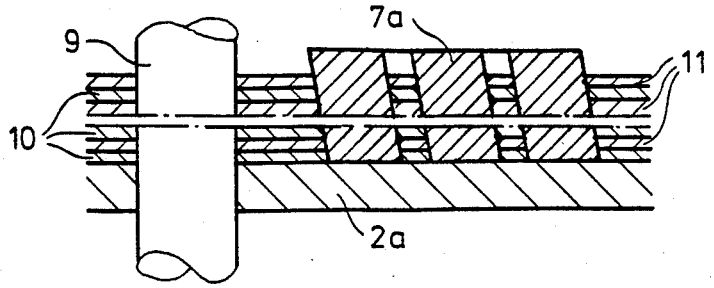

Alternating layers of nickel 10 and copper 11 are electrolytically deposited in free spaces 8*a* so that the structure shown in FIG. 5 results.

Thereafter, PMMA structures 7*a* are removed by means of an organic solvent, then copper layers 11 and electrode 2*a* are removed by means of an etching substance which does not attack the nickel layers 10 so that a sequence of mutually insulated dynode layers 10 remains which are permanently connected with the electrically insulating supports 9.

Figure 6:
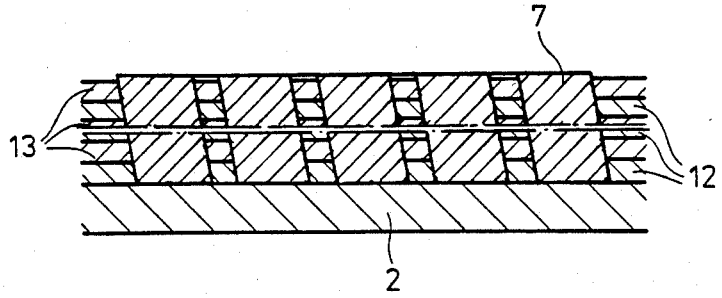
FIGS. 6 and 7 are schematic cross-sectional views of the production of a layered multichannel plate wherein the intermediate layers between the dynodes are subsequently converted to insulating metal oxide layers.
Figure 7:
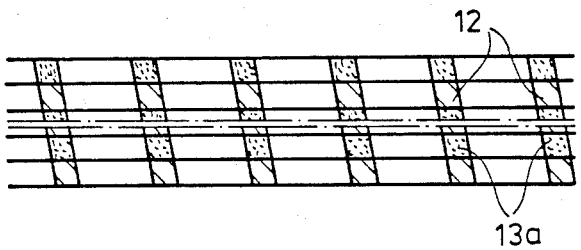

The production of layered multichannel plates having dynodes and subsequently produced intermediate layers is based on the negative mold 7 shown in FIG. 3. As shown in FIG. 6, alternating layers of nickel 12 and aluminum 13 are deposited in the free spaces 8 of negative mold 7. After removal of negative mold 7 by means of an organic solvent and of electrode 2 by means of an etching substance which attacks neither nickel layers 12 nor aluminum layers 13, the aluminum layers 13 are converted, in a known manner by way of oxidation, to aluminum oxide so that, according to FIG. 7, a layered multichannel plate results which is composed of nickel dynodes 12 and insulating intermediate layers 13*a* of aluminum oxide.

Figure 8:
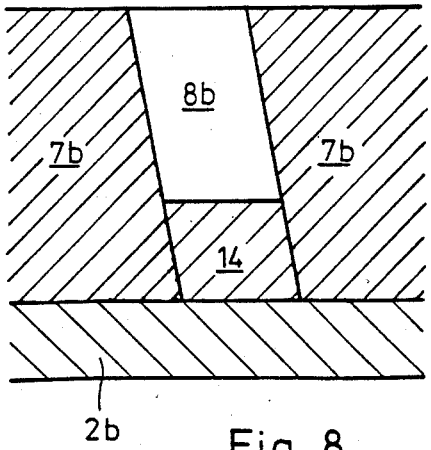
FIGS. 8 and 9 are schematic cross-sectional detail views of the production of a layered multichannel plate wherein dynodes and insulating intermediate layers are arranged successively one on top of the other.
Figure 9:
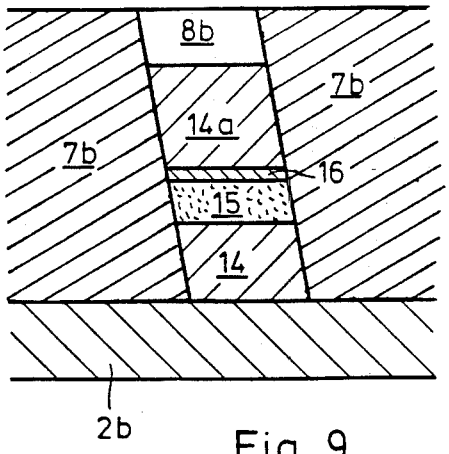

Another procedure for producing layered multichannel plates composed of a succession of dynodes and insulating intermediate layers on top of one another is also based on the negative mold 7 shown in FIG. 3. As can be seen in the simplified illustration of FIG. 8, a metal electrode 2*b* is used to precipitate from an organic electrolyte an aluminum layer 14 in the free spaces 8*b* between columnar PMMA structures 7*b*. This layer is partially converted to aluminum oxide by anodic oxidation in a second electrolyte containing sulfuric acid so that a firmly adhering aluminum oxide layer 15 is formed as shown in FIG. 9. This aluminum oxide layer is activated and coated with a thin metal layer 16 by means of chemical reduction precipitation, and an aluminum layer 14*a* is precipitated upon layer 16. This process sequence is repeated until the desired number of layers has been produced whereupon negative mold 7*b* and electrode 2*b* are removed.

Details of the electrolytic production of thin aluminum layers are described, for example, by S. Birkle, J. Gering and K. Stöger, in the periodical "Metall" [Metal], No. 4, April, 1982, while details about the subsequent conversion to an oxide can be found, for example, in the Handbuch der Galvanotechnik [Handbook of Electroplating], Volume 1, Part 2, pages 1041–1043, published by Carl Hauser Verlag, Munich, 1964.

The production of the embodiments includes the following process steps:

A 0.5 mm thick PMMA layer is generated by coating a lapped stainless steel plate with Plexit 74, which is a mold material produced by Röhm GmbH, Darmstadt, F.R.G. The X-ray mask consists of a titanium foil as a carrier and an absorber generated by electrodeposition of gold into a high-aspect ratio resist structure. The thickness of the titanium foil is 3 $\mu$m and the thickness of the absorber is 15 $\mu$m. The intergral dosage in the parts of the PMMA layer which are irradiated by synchrotron radiation is 1000 J/cm$^3$. The irradiated parts are removed by means of a developer solution consisting of 20% tetrahydro-1,4-oxazine, 5% monoethanol amine, 10% water, and 65% diethylene glycol monobutyl ether at a temperature of 35° C. The deposition of the alternating layers of nickel and copper in the grid-shaped spaces between the columnar PMMA structures is carried out in a nickel sulfamate plating bath at 57° C. and in a copper sulfate bath at 35° C. The electrically insulating supports are made from quartz with a typical spacing of 3 mm between the supports. The remaining PMMA is irradiated by highly energetic electrons and then dissolved by means of dichloromethane. The copper layers are removed by means of a commercial stripping agent as used in the fabrication of printed circuits.

The aluminum layers are electrodeposited in an organic plating bath consisting of $AlCl_3$, $LiAlH_4$ and diethylether in a nitrogen atmosphere. The oxidation of aluminum is carried out in hot water vapor.

The secondary negative mold is also fabricated from Plexit 74 which is brought in a liquid form into the positive mold. The columnar structures of the polymerized Plexit are fixed on a metallic base plate which is provided with holes for a form-locking connection between the base plate and the columnar structures. In order to facilitate the mechanical separation between the metal positive mold and the secondary negative mold, an internal separating agent (type PAT 665, produced by Würtz GmbH, Bingen, F.R.G.) is admixed to Plexit 74.

It will be understood that the above description of the present invention is susceptible to various modifications, changes and adaptations, and the same are intended to be comprehended within the meaning and range of equivalents of the appended claims.

What is claimed is:

1. In a method for producing a multichannel plate containing metal dynodes and having a plurality of generally parallel channels for use in structures for amplifying or converting optical images or other two-dimensional signal patterns by secondary electron multiplication, the improvement comprising:

(a) producing a negative mold of the plate, which negative mold has structures corresponding to the channels and is mounted on a metal electrode, the negative mold being produced pursuant to a fabrication procedure including the steps of:

(i) providing a body having at least the thickness of the plate to be produced and made of an electrically insulating material whose ability to be removed from the body is altered by exposure to a selected radiation;

(ii) irradiating the body with the selected radiation in a pattern corresponding to the plate to be produced and in a manner to render portions of the body having the form of a grid surrounding the channels more easily removable than the remaining portions of the body; and (iii) removing the more easily removable portions of the body to leave columnar structures corresponding to the channels in the plate;

(b) depositing metal layers and intermediate layers alternatingly in the openings in the negative mold, the metal layers being deposited electrolytically and forming dynodes which are spaced apart in the direction of the channels; and (c) removing the negative mold from the deposited layers.

2. A method as defined in claim 1 wherein said intermediate layers are of electrically insulating material.

3. A method as defined in claim 1 wherein said intermediate layers are initially electrically conductive and comprising the further step of rendering the intermediate layers electrically insulating.

4. A method as defined in claim 3 wherein the intermediate layers are initially of a material which is more readily oxidizable than the metal layers and said step of rendering the intermediate layers insulating is carried out after said step of removing and comprises oxidizig the intermediate layers.

5. A method as defined in claim 3 wherein the intermediate layers are aluminum and are deposited electrolytically, and said step of rendering the intermediate layers insulating comprises oxidizing the intermediate layers.

6. A method as defined in claim 1 wherein said step of depositing comprises repetitively performing the operations of depositing a layer of aluminum and oxidizing a portion of the aluminum layer so that the deposited layer includes an oxidized portion which is an intermediate layer and a non-oxidized portion which is a dynode.

7. A method as defined in claim 1 wherein said step of producing a negative mold comprises: performing said fabrication procedure to produce a primary negative mold; forming a metal positive mold by electrolytic deposition in the primary negative mold; removing the primary negative mold from the metal positive mold; and producing a secondary negative mold from the metal positive mold, and wherein the secondary negative mold is the negative mold employed in said steps of depositing metal layers and intermediate layers and removing the negative mold.

8. A method as defined in claim 7 wherein said step of producing a secondary negative mold is carried out to produce a plurality of secondary negative molds, and said steps of depositing and removing the negative mold are performed in each secondary negative mold.

9. A method as defined in claim 1 wherein said step of depositing layers includes firmly connecting the metal layers to an insulating support, and comprising the further step, after said step of removing the negative mold, of removing the intermediate layers form the metal layers.

10. A method as defined in claim 9 wherein said step of removing the intermediate layers is carried out by dissolving the intermediate layers.

11. A method as defined in claim 1 wherein said fabrication procedure further includes, after said step of removing the more easily removable portions, placing the body at an elevated temperature and subjecting the body to a uniformly acting force for causing the columnar structures to assume a curved configuration.

12. A method as defined in claim 11 wherein the force is a centrifugal force.

13. A method as defined in claim 1 wherein the plate has opposed, parallel major faces between which the channels extend, and the axes of the channels are oblique to the major faces.

14. A structure comprising a plurality of multichannel plates each produced according to the method defined in claim 13, said plates being stacked so that said channels in one said plate are in alignment with said channels in each plate adjacent said one plate, and said plates being oriented relative to one another so that the axes of said channels in one said plate are inclined in the opposite direction from the axes of said channels of the immediately adjacent plates, whereby said plurality of plates present a plurality of channels which each follow a zigzag path.

15. A method for manufacturing a structure, comprising the steps of: producing a plurality of multichannel plates each according to the method defined in claim 13; and stacking said plates together so that said channels in one of said plates are in alignment with said channels in each plate adjacent said one of said plates, and orienting said plates relative to one another so that the axes of said channels in one said plate are inclined in the opposite direction from the axes of said channels of the immediately adjacent plates, whereby said plurality of plates present a plurality of channels which each follow a zigzag path.

* * * * *